US008495932B2

(12) United States Patent
Chen

(10) Patent No.: US 8,495,932 B2
(45) Date of Patent: Jul. 30, 2013

(54) TOOL FOR REMOVING LUG NUTS

(76) Inventor: Jun Fan Chen, Taichung (TW)

( * ) Notice: Subject to any disclaimer, the term of this patent is extended or adjusted under 35 U.S.C. 154(b) by 190 days.

(21) Appl. No.: 13/111,004

(22) Filed: May 19, 2011

(65) Prior Publication Data

US 2012/0291597 A1 Nov. 22, 2012

(51) Int. Cl.
*B25B 13/16* (2006.01)
*B25B 13/48* (2006.01)

(52) U.S. Cl.
USPC ..... 81/163; 81/170; 81/176.15

(58) Field of Classification Search
USPC ..... 81/163, 155, 170, 175.15, 129, 176.2
See application file for complete search history.

(56) References Cited

U.S. PATENT DOCUMENTS 6,662,689 B1 * 12/2003 Voskanyan ..... 81/163
6,715,385 B2 * 4/2004 Wu ..... 81/176.15

* cited by examiner

*Primary Examiner* — David B Thomas

(57) ABSTRACT

A tool for removing lug nuts contains a supporting post including an actuating portion and two guiding portions extending outward from two sides of the actuating portion respectively; a screw rod including a head end and a circular extension extending outward from the head end, wherein an outer diameter of the head end is more than that of the circular extension, the circular extension includes a first and a second thread sections; two retaining arm, each including a hole to insert the guiding portion, an aperture arranged on a top end thereof to communicate with the hole, and an orifice secured thereon below the hexagonal hole and having a third and a fourth thread sections to screw with the first and the second thread sections respectively so that after the screw rod is rotated, the retaining arms are driven to close to each other or leave away from each other.

5 Claims, 6 Drawing Sheets

TOOL FOR REMOVING LUG NUTS

BACKGROUND OF THE INVENTION

1. Field of the Invention

The present invention relates to a hand tool, and more particularly to a tool for removing lug nuts.

2. Description of the Prior Art

A conventional rim of vehicles with a cover is unfastened or fastened by removing lug nuts on the cover first, but a size of the lug nut is large that has to be unfastened or fastened by using a large size of retaining tool. Besides, such a retaining tool is easy to damage the lug nuts.

To improve such a problem, an improved tool for removing the lug nuts has been developed, however, such an improved tool can not be positioned precisely based on a desired retaining size and can not be fixed securely, thus hurting a user and damaging the lug nut.

The present invention has arisen to mitigate and/or obviate the afore-described disadvantages.

SUMMARY OF THE INVENTION

The primary object of the present invention is to provide a tool for removing lug nuts that is capable of being positioned precisely and securely.

A tool for removing lug nuts in accordance with the present invention contains:

a supporting post including an actuating portion and two guiding portions extending outward from two sides of the actuating portion respectively;

a screw rod including a head end and a circular extension extending outward from the head end, wherein an outer diameter of the head end is more than that of the circular extension, and the circular extension includes a first thread section and a second thread section;

two retaining arm, each including a hole fixed thereon to insert the guiding portion and an orifice secured thereon below the hexagonal hole and having a third thread section and a fourth thread section to screw with the first and the second thread sections respectively so that after the screw rod is rotated, the retaining arms are driven to close to each other or leave away from each other.

DETAILED DESCRIPTION OF THE PREFERRED EMBODIMENTS

Figure 1:
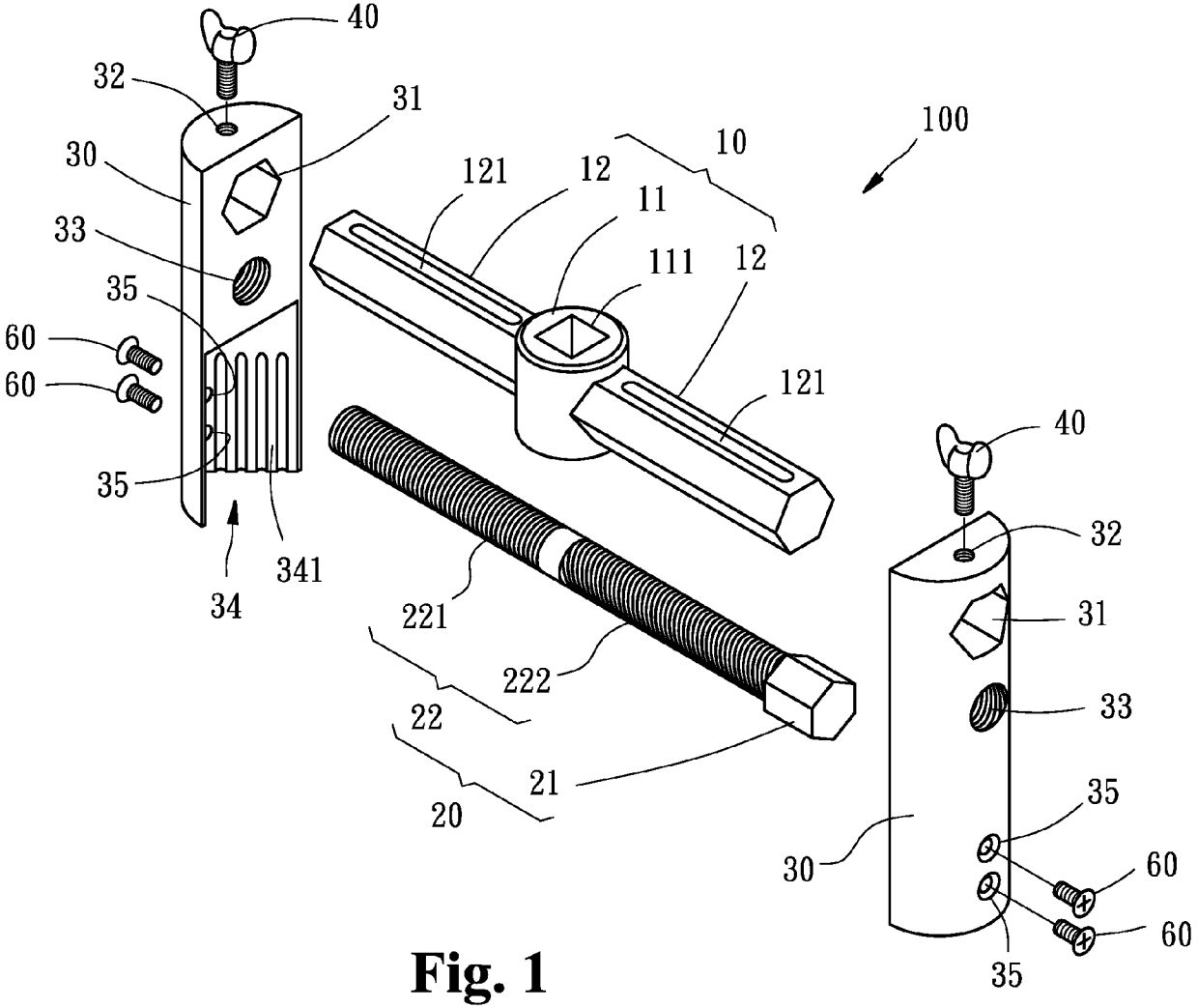
FIG. 1 is a perspective view showing the exploded components of a tool for removing lug nuts in accordance with a preferred embodiment of the present invention.

The present invention will be clearer from the following description when viewed together with the accompanying drawings, which show, for purpose of illustrations only, the preferred embodiment in accordance with the present invention.

Referring to FIGS. 1-6, a tool 100 for removing lug nuts in accordance with a preferred embodiment of the present invention comprises a supporting post 10, a screw rod 20, two retaining arms 30, and two positioning bolts 40.

Figure 2:
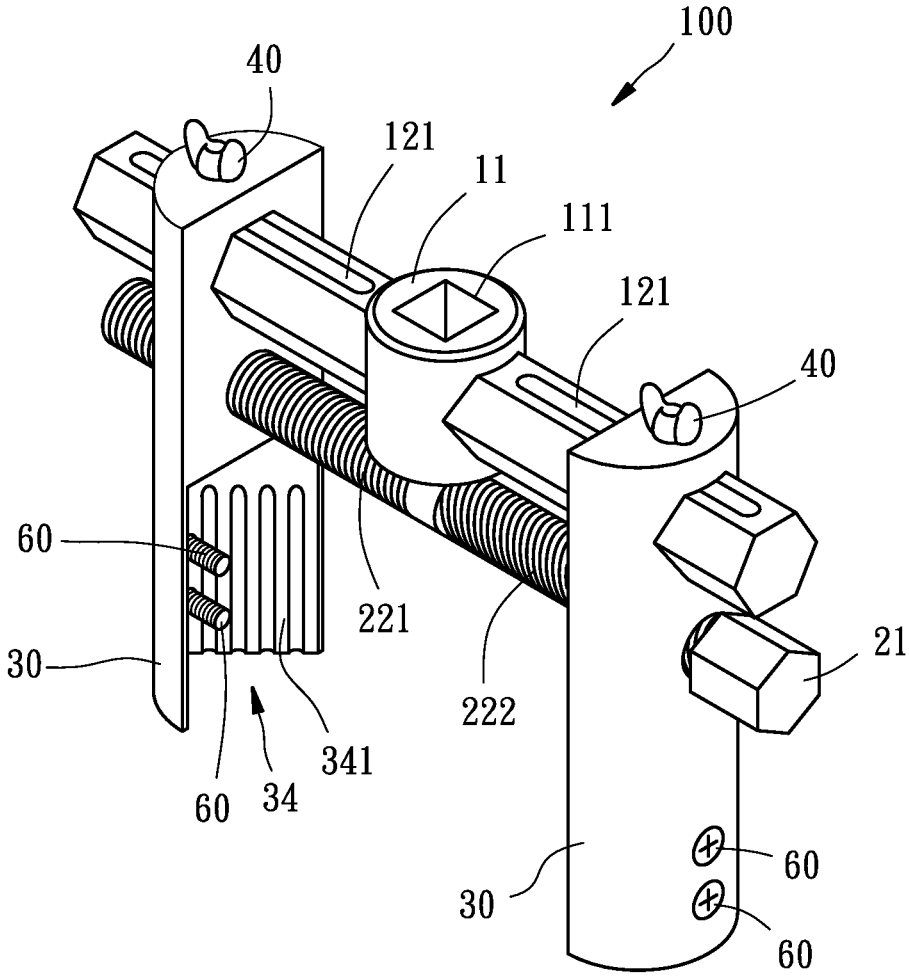
FIG. 2 is a perspective view showing the assembly of the tool for removing the lug nuts in accordance with the preferred embodiment of the present invention.

As shown in FIGS. 1-2, the supporting post 10 is integrally formed and includes an actuating portion 11 and two guiding portions 12 extending outward from two sides of the actuating portion 11 respectively, and the actuating portion 11 includes a groove 111 formed thereon, wherein the groove 111 is formed in a rectangle shape, and a cross section of each guiding portion 12 is formed in a hexagon shape, the guiding portion 12 includes an elongated notch 121 disposed on an outer surface thereof.

The screw rod 20 includes a head end 21 and a circular extension 22 extending outward from the head end 21, wherein a cross section of the head end 21 is formed in a hexagon shape, and an outer diameter of the head end 21 is more than that of the circular extension 22, the circular extension 22 includes a first thread section 221 and a second thread section 222.

Each retaining arm 30 includes a hexagonal hole 31 fixed thereon to correspond to the cross section of the guiding portion 12 of the supporting post 10 and to insert the guiding portion 12, an aperture 32 arranged on a top end thereof to communicate with the hexagonal hole 31, and an orifice 33 secured thereon below the hexagonal hole 31 and having a third thread section and a fourth thread section to screw with the first and the second thread sections 221, 222 respectively so that the head end 21 extends out of one of the two retaining arms 33, the retaining arm 30 also includes a recess 34 formed on an inner side thereof, and the recess 34 includes an engaging segment 341 arranged therein and comprised of a plurality of ribs and slots, the retaining arm 30 further includes two openings 35 disposed on a lower side thereof to communicate with the engaging segment 341 of the recess 34.

Each positioning bolt 40 is screwed into the elongated notch 121 of the supporting post 10 from the aperture 32 of the retaining arm 30.

Figure 3:
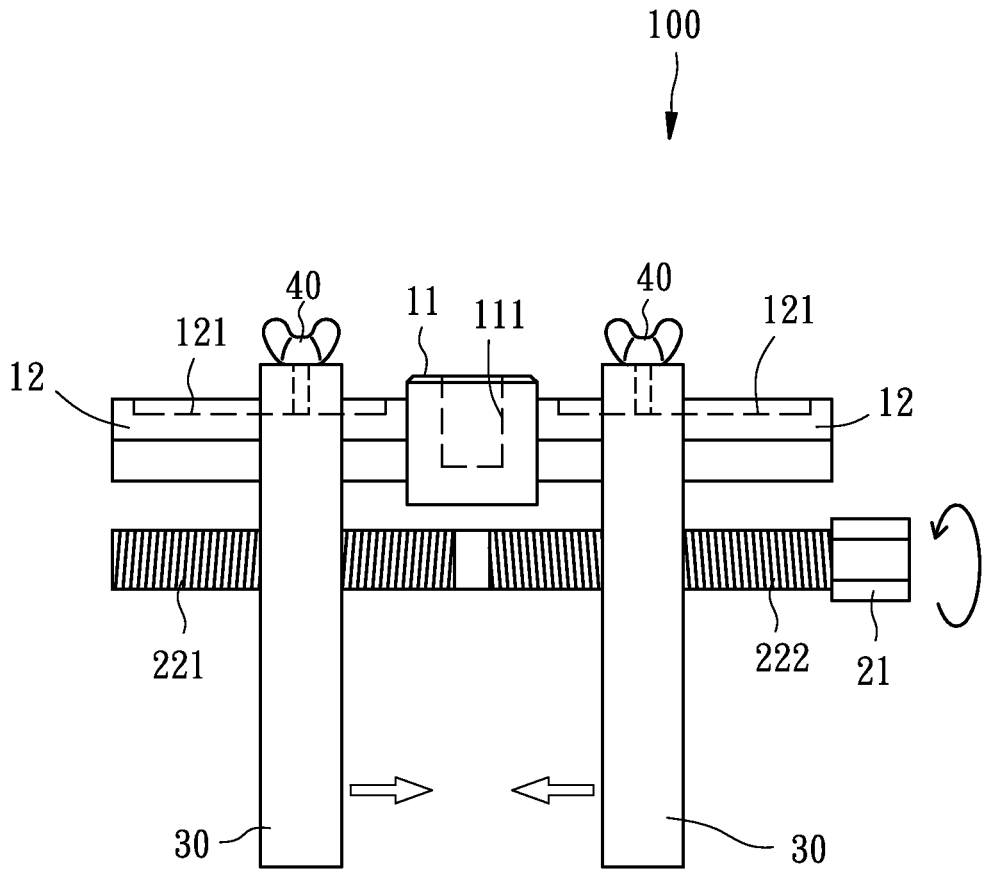
FIG. 3 is a cross sectional view showing the operation of the tool for removing the lug nuts in accordance with the preferred embodiment of the present invention.
Figure 4:
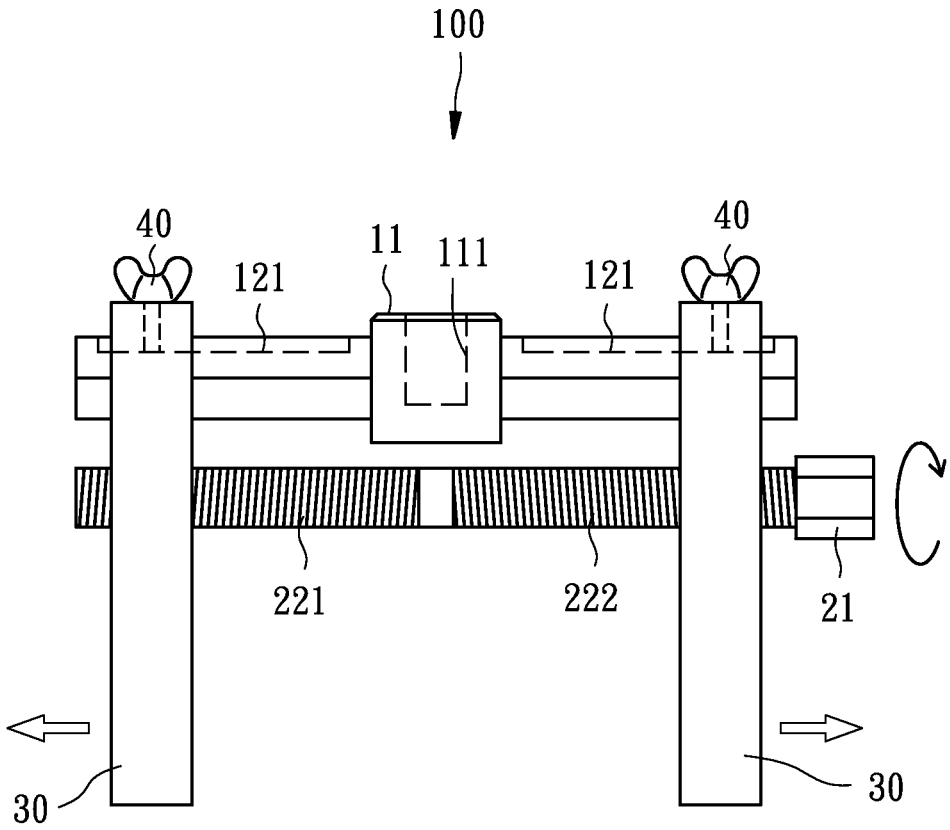
FIG. 4 is another cross sectional view showing the operation of the tool for removing the lug nuts in accordance with the preferred embodiment of the present invention.

With reference to FIGS. 3 and 4, in operation, the positioning bolts 40 are unfastened to prevent from contacting with a bottom end of the elongated notches 121 individually, and then the screw rod 20 is rotated by rotating the head end 21 of the screw rod 20 in a clockwise and or an anti-clockwise direction so that the first and the second thread sections 221, 222 actuate the two retaining arms 30 to be engaged or disengaged respectively. After the retaining arms 30 are engaged at a suitable position (e.g., the engaging segments 341 of the retaining arms 30 are engaged on two opposite outer sides of a nut individually), the positioning bolts 40 are rotated tightly so hat two bottom ends of the two positioning bolts 40 are axially engaged in the elongated notches 121 to position the two retaining arms 30, hence a wrench (not shown) is fitted in the groove 111 to be further rotated so that the tool 100 is actuated by the wrench, thus unfastening or fastening the lug nut.

Thereafter, the tool 100 of the present invention is positioned precisely and securely. In addition, the hexagonal hole 31 cooperates with the hexagonal guiding portion 12 to retain the retaining arms 30 fixedly.

Figure 5:
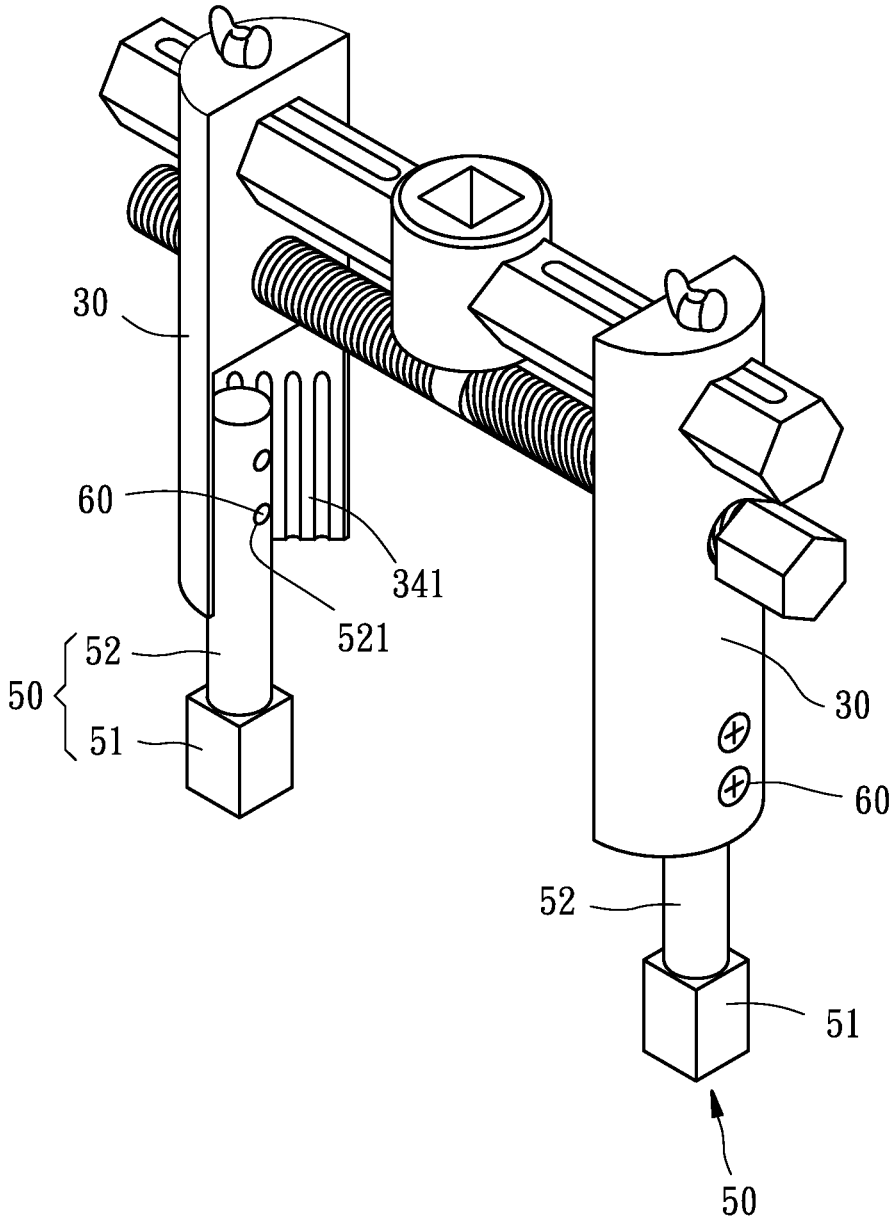
FIG. 5 is a respective view showing the operation of a tool for removing lug nuts in accordance with another preferred embodiment of the present invention.

Referring to FIG. 5, another tool 100 according to another embodiment of the preset invention is used in a narrow space, wherein the tool 100 further includes two connecting shafts 50, and each connecting shaft 50 includes a driving portion 51 and a coupling portion 52, wherein the connecting portion 52 includes two bores 521 disposed on an upper side thereof and is provided to contact with the engaging segment 341 of the retaining arm 30, two screwing elements 60 are screwed with the bores 521 of the connecting shaft 50 via the openings 35 of the retaining arm 30 individually so that the retaining arm 30 is connected with the connecting shaft 50, such that the driving portion 51 is fitted onto the lug nut to unfasten or fasten the lug nut.

Figure 6:
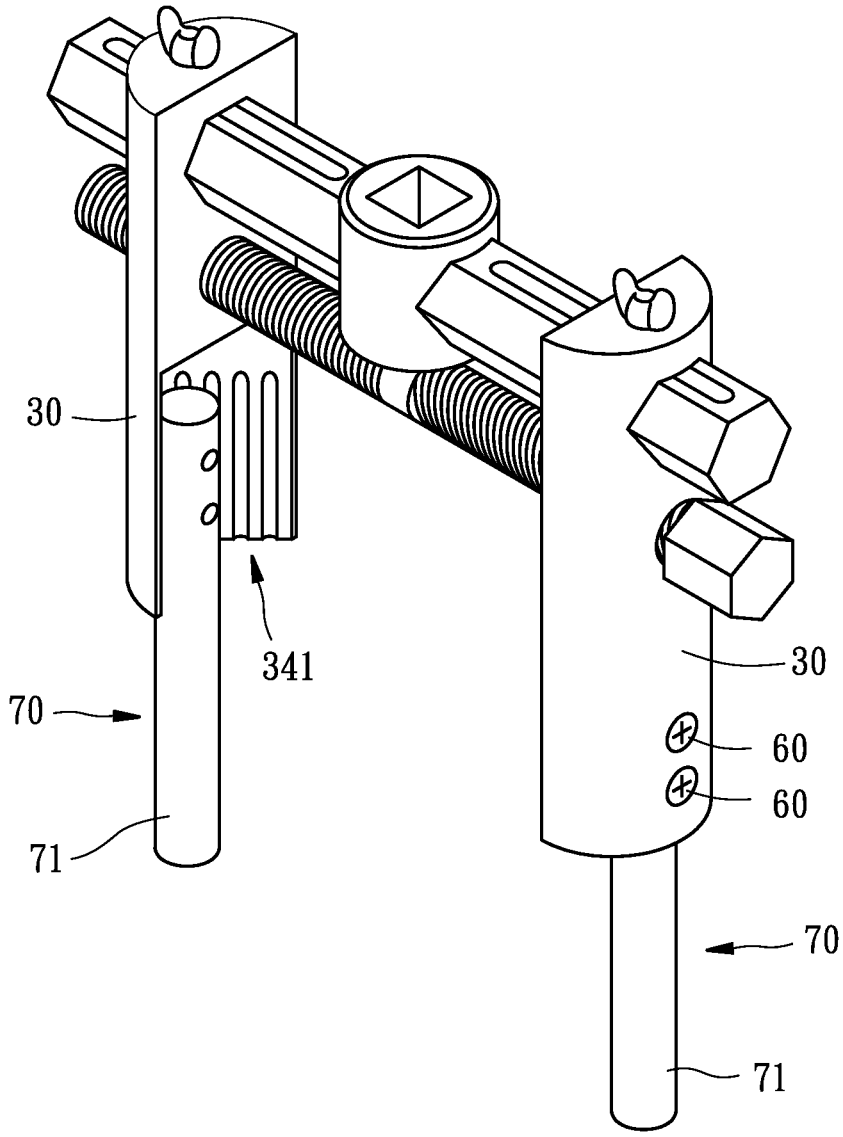
FIG. 6 is another respective view showing the operation of the tool for removing the lug nuts in accordance with another preferred embodiment of the present invention.

The driving portion 51 of the connecting shaft 50 is formed in a rectangle shape as shown in FIG. 6, and another driving portion 71 of another connecting shaft 70 is formed in a circle shape.

Furthermore, the groove 111 of the supporting post 10 is capable of being formed in another non-circler shape.

While we have shown and described various embodiments in accordance with the present invention, it is clear to those skilled in the art that further embodiments may be made without departing from the scope of the present invention.

What is claimed is:

1. A tool for removing lug nuts comprising:

a supporting post including an actuating portion and two guiding portions extending outwardly from two sides of the actuating portion respectively;

a screw rod including a head end and a circular extension extending outwardly from the head end, wherein an outer diameter of the head end is more than that of the circular extension, and the circular extension includes a first thread section and a second thread section;

two retaining arms, each including a hexagonal hole defined thereon to insert a respective one of the two guiding portions and an orifice formed thereon below the hexagonal hole, wherein two orifices of the two retaining arms have a third thread section and a fourth thread section to screw with the first thread section and the second thread sections of the circular extension so that after the screw rod is rotated, the two retaining arms are driven to close to each other or to leave away from each other;

two positioning bolts;

wherein the each retaining arm also includes an aperture arranged on a top end thereof and communicating with the hexagonal hole, each guiding portion has an elongated notch defined on an outer surface thereof, and the two positioning bolts are screwed into two elongated notches of the supporting post from two apertures of the two retaining arms;

wherein a cross section of the each guiding portion is formed in a hexagon shape.

2. The tool for removing the lug nuts as claimed in claim 1 further comprising two connecting shafts, and each connecting shaft including a driving portion and a coupling portion, wherein the coupling portion is provided to contact with an engaging segment of the each retaining arm.

3. The tool for removing the lug nuts as claimed in claim 2, wherein the coupling portion includes two bores formed on an upper side thereof, two screwing elements are screwed with the two bores of the connecting shaft via two openings of the each retaining arm so that the each retaining arm is connected with the each connecting shaft, such that the driving portion is fitted onto a lug nut to unfasten or fasten the lug nut.

4. The tool for removing the lug nuts as claimed in claim 1, wherein the actuating portion includes a groove formed thereon, and the groove is formed in a rectangle shape.

5. The tool for removing the lug nuts as claimed in claim 1, wherein the each retaining arm also includes a recess formed on an inner side thereof, and the recess includes the engaging segment arranged therein, and the engaging segment is comprised of a plurality of ribs and slots.

* * * * *